US005882189A

United States Patent [19]

Fehsenmayr et al.

[11] Patent Number: 5,882,189

[45] Date of Patent: Mar. 16, 1999

[54] SLIDING GRATE FOR A BURNT-MATERIAL-COOLING UNIT, AND GRATING PLATE THEREFOR

[75] Inventors: Theo Fehsenmayr, Aalen; Reiner Frühling, Hamburg; Frank Heinrich, Harsefeld; Hartmut Meyer, Thomasburg, all of Germany

[73] Assignee: Babcock Materials Handling Division GmbH, Buxtehude, Germany

[21] Appl. No.: 817,685

[22] PCT Filed: Oct. 30, 1995

[86] PCT No.: PCT/EP95/04259

§ 371 Date: Apr. 23, 1997

§ 102(e) Date: Apr. 23, 1997

[87] PCT Pub. No.: WO96/13692

PCT Pub. Date: May 9, 1996

[30] Foreign Application Priority Data

May 9, 1996 [DE] Germany ..... 94 17 515.2

[51] Int. Cl.[6] ..... F23H 11/10

[52] U.S. Cl. ..... 432/78; 110/268; 110/281

[58] Field of Search ..... 432/77, 78; 110/298, 110/299, 281, 282, 283, 268, 289, 290

[56] References Cited

U.S. PATENT DOCUMENTS

| | | | |
|---|---|---|---|
| 4,876,972 | 10/1989 | Mrklas | 110/298 |
| 5,174,747 | 12/1992 | Massaro, Jr. et al. | 432/78 |
| 5,433,157 | 7/1995 | Dittmann et al. | 432/78 |
| 5,549,471 | 8/1996 | Tegtmeier et al. | 432/77 |
| 5,575,642 | 11/1996 | Willis et al. | 432/78 |
| 5,626,089 | 5/1997 | Schneider et al. | 432/78 |

FOREIGN PATENT DOCUMENTS

| | | | |
|---|---|---|---|
| 0 337 383 A1 | 4/1989 | European Pat. Off. | F27D 15/02 |
| 477467 | 4/1992 | European Pat. Off. | 432/77 |
| 525380 | 2/1993 | European Pat. Off. | 432/77 |
| 0 537 523 B1 | 12/1994 | European Pat. Off. | F27D 15/02 |
| 90 12 812.5 U1 | 7/1990 | Germany | F27D 15/02 |
| 42 05 534 A1 | 8/1993 | Germany | F27D 15/02 |
| 457860 | 4/1975 | U.S.S.R. | 432/77 |

*Primary Examiner*—Teresa Walberg
*Assistant Examiner*—Gregory A. Wilson
*Attorney, Agent, or Firm*—Alix, Yale & Ristas, LLP

[57] ABSTRACT

Described is a grating plate for a sliding grating for a burned-material cooling unit, the grating plate having, in the surface which holds the materials, a recess (13) in which cooling-air outlets (10) are located and, below the recess, a cooling-air feed space (17). The depth of the recess (13) increases from back to front. The cross-section of the cooling-air feed space (17) decreases correspondingly from back to front in accordance with the change in the cooling-air flow through the space.

12 Claims, 3 Drawing Sheets

SLIDING GRATE FOR A BURNT-MATERIAL-COOLING UNIT, AND GRATING PLATE THEREFOR

CROSS-REFERENCE TO RELATED APPLICATIONS

This is the national stage of International Application No. PCT/EP95/04259 filed Oct. 30, 1995.

BACKGROUND OF THE INVENTION

Known sliding gratings such as those which are used for cooling cement clinker and other, pourable burnt material comprise a plurality of rows, running transversely with respect to the longitudinal and advancement direction of the cooling unit, of grating plates which are alternately stationary and moved back and forth in the conveying direction, the grating plates arranged one behind the other overlapping one another in an imbricated manner. The bed of material which is to be cooled moves over the upper side of the plates and has a wearing effect on the same. It is known (EP-C 337383; EP-A 537523; U.S. Pat. No. 5,174,747), for the upper side of the plates to be provided, in the material-receiving surface over which the bed of material slides, with depressions, in which material particles are held and in which cooling-air-outlet openings open out. This arrangement has the advantage that the cooled material held in the depressions protects the grating-plate region located therebeneath against the thermal and wearing action of the bed of material sliding over it, and that the cooling air is well distributed by the material located in the depressions. Since the front plate section is at particular risk of wear, it is provided, essentially over its entire width, with one or more such depressions. In contrast, the rear section is subjected to thermal action to a lesser degree because it is overlapped to a periodically alternating extent by the grating plate arranged behind. In order that this plate which is arranged behind can slide over the plate in front without being spaced apart therefrom to a pronounced extent, the surface of said rear section is usually designed to be more or less smooth and parallel to the direction of relative movement. It is referred to as the sliding surface hereinbelow.

The known plates provided, in the front section, with depressions on top have a cooling-air-supply space which is connected to the cooling-air-outlet openings and has a cooling-air-supply opening which is connected to the associated grating-plate carrier. The latter is a hollow carrier which is assigned to each row, the cavity of which is used for cooling-air supply, and on which the grating plates are mounted with their rear region projecting forwards.

In order to be able to hold some of the material better, the depressions in the material-receiving surface are designed with steep delimiting surfaces and to be as deep as possible in comparison with the plate height provided. This means that there is only a small cross-section remaining for the cooling-air-supply space located therebeneath, as a result of which the supply of cooling air to those cooling-air-outlet openings which are arranged further towards the front in the plate and for which the cooling requirement is particularly high is poorer than for those openings which are arranged further towards the rear. Although the cross-section of the cooling-air-supply space could be increased by selecting a larger plate height, this increases the material requirement, which determines costs. Moreover, the higher plates then no longer match the hitherto conventional, lower plates.

BRIEF SUMMARY OF THE INVENTION

The object of the invention is thus to improve, without major cost, a sliding grating of the type explained and an associated grating plate as far as the supply of air to the cooling-air-outlet openings is concerned.

This object is achieved in that the depression of the material-receiving surface is not as deep at the rear as it is at the front, with the result that the cross-section of the cooling-air-supply space correspondingly decreases towards the front from the rear. Advantageously, the material-receiving surface slopes downwards gradually towards the front from the rear. Furthermore, the configuration is expediently such that the reduction in cross-section of the cooling-air-supply space corresponds approximately to the reduction in the quantity of cooling air which passes through. This achieves a uniform speed profile for the cooling air within the cooling-air-supply space and uniform flow into the bed of clinker, especially if the cooling-air-outlet openings are distributed uniformly over the length of the corresponding grating-plate section, preferably in the form of longitudinal slits. As a result of the relatively small drop in pressure in the cooling-air-supply space, the supply of cooling air to those cooling-air-outlet openings, or those parts of the cooling-air-outlet slits, which are located further towards the front is better, and the front plate part, which is particularly exposed to the action of heat from the bed of material, is better cooled.

The effect which it is intended to achieve by means of the depression is not adversely affected by the gradual or stepwise downward slope of the material-receiving surface for forming the depression on the top of the grating plate. The thickness of the quantity of material held in the rear, shallower region of the depression is indeed smaller than in the front region, with the result that the cooling effect thereof is not as great, a greater exchange of the material held possibly also taking place. However, it is also the case that, in the rear region of the depression, the plate does not require as much cooling or protection against heat. This is because, on the one hand, the rear region of the depression has more favourable heat-dissipation conditions than the more protected plate section further towards the rear. On the other hand, the front region, in the vicinity of the end, of the front section of the material-receiving surface of the grating plate is exposed to a more pronounced extent to the wearing and thermal action from the bed of material.

The reference surface to which the downward slope of the material-receiving surface relates is formed by the imaginary plane which connects the sliding surface of the rear grating-plate section to the upper edge of the end strip delimiting the grating plate at the front.

In order that, despite the depression of the material-receiving surface being of a shallower design in the rear region, it is possible for said depression to hold cool material sufficiently, it is expediently provided with a device which obstructs the material from moving in the longitudinal direction relative to the grating plate, said device being, for example, one or more transverse ribs.

The cooling-air-outlet openings are expediently formed by longitudinal slits in the cover wall, which forms the base of the depression, which longitudinal slits, including their borders are covered by covering strips. Consequently, the cooling-air-outlet openings open out in approximately the horizontal direction, which reduces the possibility of material dropping through, disadvantageously.

According to a particular feature of the invention, the cover strips are arranged such that they cannot expand in the longitudinal direction with respect to the cover wall, so that the width of the outlet slits cannot be reduced by thermal expansion. The cover strips are expediently connected firmly, preferably integrally, to the part which forms the sliding surface and, if appropriate, also to the end strip, while the cover wall forms a separate part, which is expediently connected firmly, and if appropriate integrally, to the base wall, which delimits the cooling-air-supply space at the bottom. This has the advantage that it is possible to select a material for those parts which are located at a higher level, and are therefore exposed to harsher treatment, which is different from the material of the cover wall and base wall, which are located at a lower level.

According to a particular feature of the invention, in the vicinity of the front end of the cover strips, an abutment surface is provided between the top plate part, which comprises the cover strips, and the bottom plate part, which comprises the cover wall, the direction of which abutment surface differs from the direction of the surfaces of the cover wall and of the cover strips, said surfaces delimiting the cooling-air-outlet openings, with an upwardly open, obtuse angle being formed in the process. If, in operation, the top plate part is exposed to more pronounced thermal action, it expands to a more pronounced extent than the bottom plate part. Since the two plate parts are connected to one another in the rear section of the grating plate, this results in a forward movement of the cover strips relative to the cover wall. The direction of this forward movement can be influenced by the abutment surface. If the angle of the latter differs from the direction of the surfaces delimiting the cooling-air-outlet openings, this relative movement results in an increase in the cooling-air-outlet openings. In other words, in the case of the plate being subjected to thermal action to a greater degree, this feature results in an increase in the cooling-air-outlet openings, and thus in increased cooling, in comparison with the case of the plate being subjected to thermal action to a lesser degree.

The depression in the material-receiving surface expediently extends over the entire grating-plate width. The longitudinal gap between two adjacent grating plates may be covered by an insertion strip in order to avoid the situation where material drops through the gratings.

BRIEF DESCRIPTION OF THE DRAWINGS

The invention is explained in more detail hereinbelow with reference to the drawing, which depicts an advantageous exemplary embodiment, and in which.

DETAILED DESCRIPTION OF THE INVENTION

Figure 1:
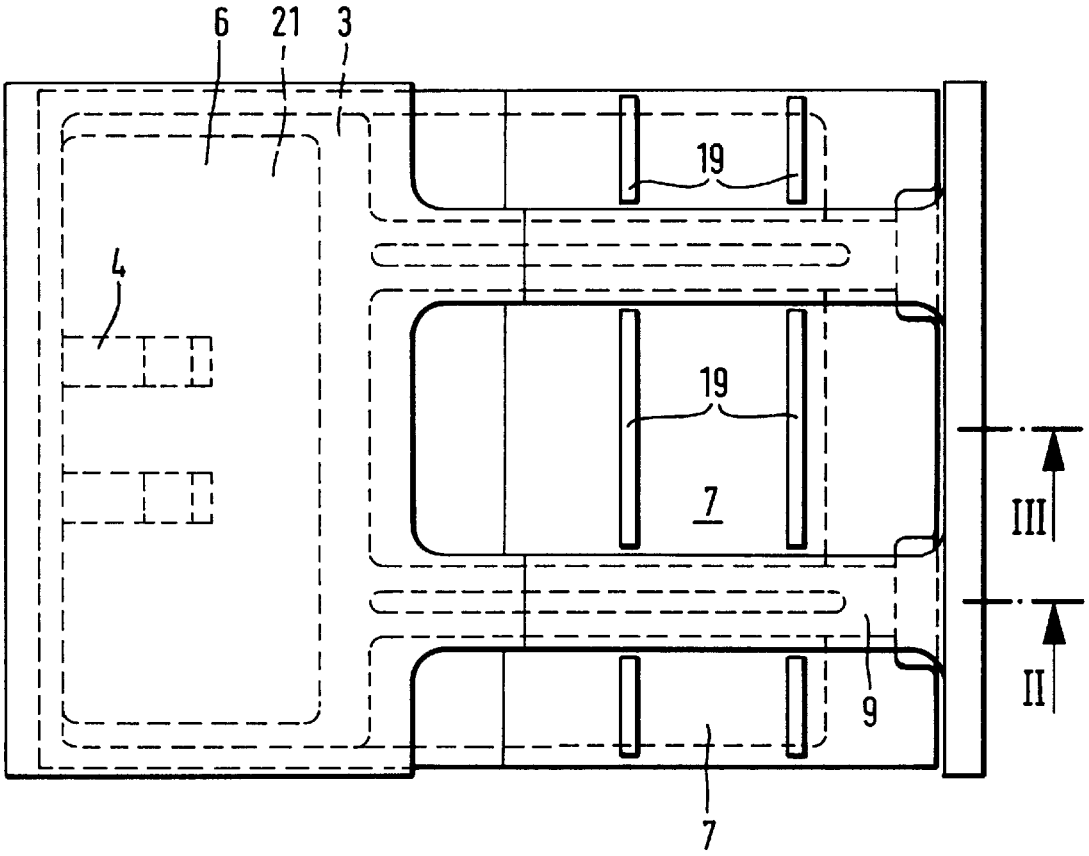
FIG. 1 shows a plan view.
Figure 2:
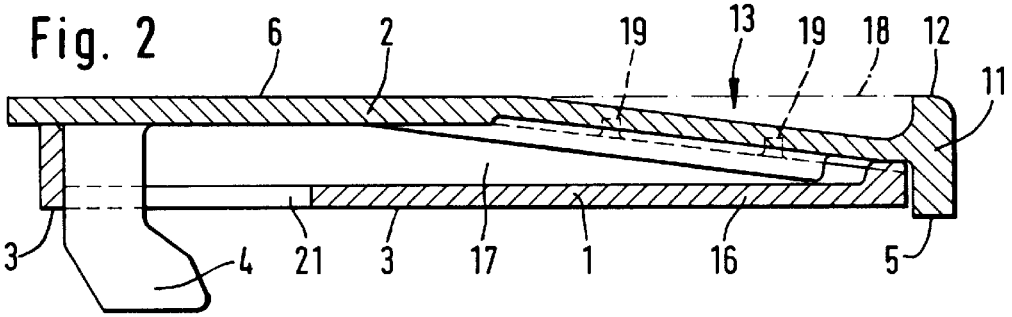
FIGS. 2 and 3 show longitudinal sections along lines II and III of FIG. 1, FIGS. 4 and 5 show cross-sections along lines IV and V of FIG. 3, FIGS. 6 and 7 show partial cross-sections through adjacent plates.

The grating plate comprises a bottom plate part 1 (hatching which slants upwards to the right) and a bottom plate part 2 (hatching which slants downwards to the right). In the plate rear section, illustrated on the left in FIGS. 1 to 3, the bottom plate part 1 forms a cooling-air-supply opening 21, of which the border 3 can be positioned in a close-fitting manner on the border of a corresponding opening of a grating-plate carrier (not illustrated). The grating plate can be fastened on the grating-plate carrier in a known manner by means of fastening lugs 4. The grating plate projects forwards from the grating-plate carrier in order to engage, by means of its front section, and in particular by means of its front lower edge 5, over the sliding surface 6 formed by the rear section of the upper side of the next-following grating plate.

The upper side of the plate is formed, on the one hand, by the essentially planar rear sliding surface 6, over which the front part of the next grating plate to the rear slides backwards and forwards. In the front section of the plate, the upper side of the latter is formed by a cover wall 7 which slopes obliquely downwards towards the front from the rear and is interrupted at two points in the form of a longitudinal opening 8 in each case. Each longitudinal opening is covered by a cover strip 9, of which the borders form, with the borders of the opening, cooling-air-outlet slits 10 which are overlapped by part of the cover strip 9 and open out horizontally level with the upper side of the cover wall 7. The upper sides of the cover wall 7 and of the cover strips 9 together form the material-receiving surface.

At the front, the cover strips 9 terminate integrally in the end strip 11 of the grating plate. Instead of this, however, it would also be possible for said end strip to be exchangeable as a wearing part. The upper edge 12 of the end strip 11 is located a t approximately the same level as the planar, rear sliding surface 6 of the upper side of the grating plate. The cover wall 7 and the cover strips 9 are located at a lower level than the imaginary plane 18 which connects them.

The cover wall and the cover strips together form the base of the depression 13, which extends transversely between the end strip 11 and the rear sliding surface 6. At the sides, the depression (unlike the illustration in the drawing) may be delimited by border strips, which likewise may be arranged at a lower level than the connecting plane 18.

At the front, the cover wall 7 terminates integrally with the front border of the base wall 16. The side borders of the cover wall 7 and of the base wall 16 are connected by walls 15, with the result that a cooling-air-supply space 17 is enclosed between the cover wall 7, the base wall 16 and the side walls 15, said cooling-air-supply space 17 being connected, on the one hand, to the cooling-air-supply opening 21 at the rear and, on the other hand, to the cooling-air-supply slits 10. Since the cover wall 7 and the cover strips 9 slope uniformly downwards towards the front from approximately the level of the rear, top section 6, the cross-section of the cooling-air-supply space 17 is correspondingly reduced uniformly towards the front from the rear. This reduction in cross-section corresponds to the reduction in the quantity of cooling air which has to pass through this space in order to reach the cooling-air-outlet slits 10. This thus achieves a uniform flow of the cooling air to the cooling-air-outlet slits 10 and a correspondingly uniform flow into the bed of material. Even the foremost plate region is reached by a sufficient amount of cooling air.

Transverse ribs 19 project upwards from the surface of the cover wall 7, these ribs helping to hold the material located in the depression 13 and to prevent this material from relative movement in the longitudinal direction.

Figure 3:
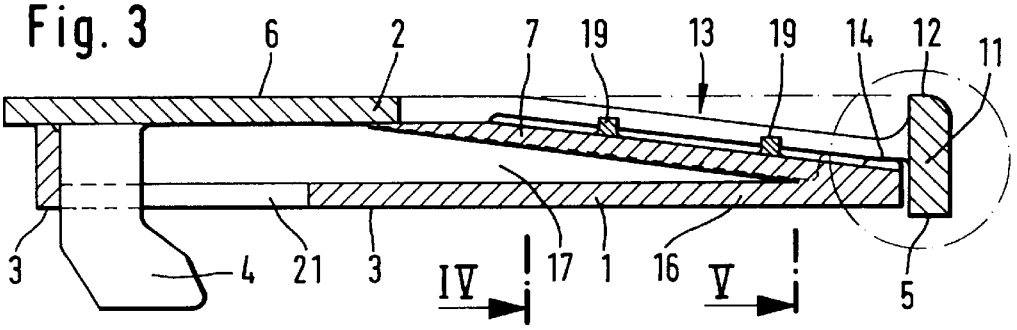
Figure 4:
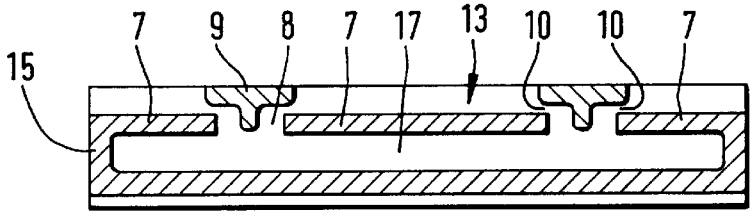
Figure 5:
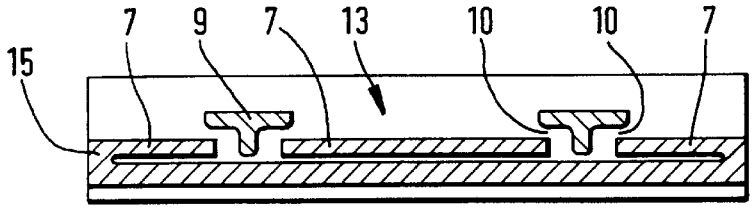
Figure 6:
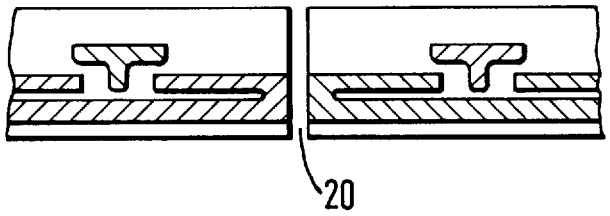
Figure 7:
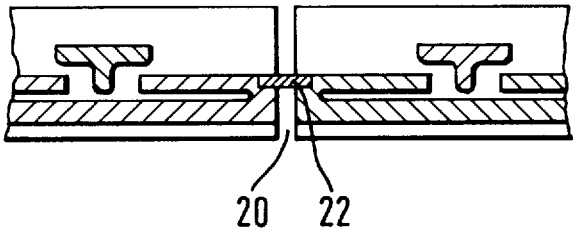
Figure 8:
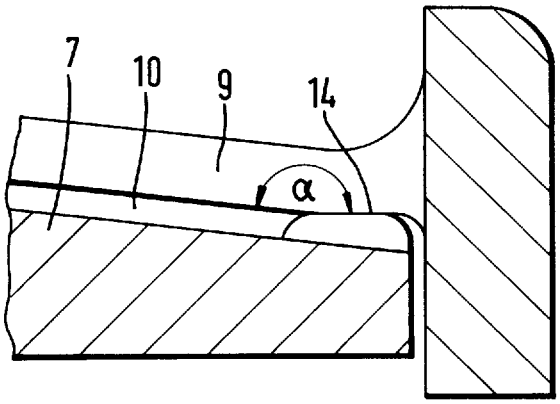
FIG. 8 shows, on an enlarged scale, a detail from FIG. 3.

The depression 13 extends over the entire width of the plate and continues in the adjacent plates, provided these are of the same design. The gap 20 between adjacent plates is then also located within the depression (FIG. 6). If the top delimitation of the gap 20 is located within the stationary material which is held in the depression, the quantity of fine material which drops into the gap remains small. This is all the more the case since the cooling-air stream, according to FIG. 3, is directed parallel to the base of the depression and there is thus a high likelihood of any fine material which passes into the depression being removed with the cooling-air stream before it reaches the gap between the plates. However, it is also possible to provide additional sealing means for the gap 20 between the plates, for example the covering strip 22 illustrated in FIG. 7.

The top delimitation of the cooling-air-outlet slits 10 is formed by the cover strips 9, which belong to the top plate part and, at the front end, do not expand with respect to the bottom plate part. The bottom delimitation of the cooling-air-outlet slits 10 is formed by the cover wall 7 which belongs to the bottom plate part. Due to the fact that these parts are positioned obliquely, the bottom delimitation is arranged further towards the rear than the top one. In operation the cover part 2 of the grating plate assumes a higher temperature and will expand to a more pronounced extent than the base part 1 of the grating plate. This results in the top and front delimitation of the cooling-air-outlet gap 10 being displaced forwards to a more pronounced extent than the bottom delimitation, which means an increase in the cross-section of the cooling-air-outlet slit. In this context, it may be advantageous if the top grating-plate part or the front end of the cover strips 9 is supported on the bottom grating-plate part via an abutment surface 14, which encloses an upwardly open, obtuse angle alpha with the delimiting surfaces of the cooling-air-outlet slit 10. For example, the surface 14 may run horizontally and parallel to the imaginary plate surface 18. Arranging the abutment surface 14 at an angle to the slit 10 prevents the front end of the gap-delimiting surface of the cover strip 9 from being displaced parallel to the slit delimiting surface of the cover wall 7 or from approaching the latter at all. The effect of an increase in the cooling-air-outlet cross-sections when the plate is subjected to thermal action to a relatively high degree is more pronounced as the degree to which the grating plate is subjected to thermal action becomes higher. The same effect is achieved by the thermal bending to which the top plate part of the grating plate is exposed. The cover strips 9 assume a higher temperature on their upper side than on their underside. This results in them curving upwards to a slight extent. Since they are supported at the front end by resting on the front end of the bottom part 1 of the grating plate, they curve away from the bottom delimitation of the air-outlet slits 10.

The exemplary embodiment shows the cover plate 7 and the cover strips 9 sloping downwards in a uniform and rectilinear manner approximately from the level of the rear sliding surface 6 virtually down to the level of the base plate 16. In this arrangement, the cover wall 7 forms a small step at the transition to the rear, top plate section 6 (FIG. 3), and this step is favourable for holding cool material. It is also possible for the step to be dispensed with, as is the case with cover strips 9, or to be designed in a more pronounced manner. It is also possible for the downward slope to be formed in a number of steps instead of in a continuous manner.

We claim:

1. Sliding grating for a cooling unit for burnt material such as cement clinker, having at least one grating plate, of which the rear section of the upper side forms a sliding surface (6), which interacts with an overlapping plate which is arranged behind said first-mentioned grating plate, as seen in the longitudinal direction of the grating, and the front section of the upper side forms a material-receiving surface, at least part of which material-receiving surface is formed as a depression (13) in relation to the sliding surface (6) and the upper edge (12) of an end strip delimiting said depression at the front, and in which material-receiving surface cooling-air-outlet openings (10) open out, said openings emerging from a cooling-air-supply space (17) which is located between a cover wall (7), which helps to form the material-receiving surface, and a bottom base wall (16), which has a cooling-air-supply opening (21) in the rear section of the grating plate, characterized in that the depth of the depression (13) increases towards the front from the rear, and the cross-section of the cooling-air-supply space (17) decreases towards the front from the rear.

2. Sliding grating according to claim 1, characterized in that the material-receiving surface slopes downwards gradually towards the front from the rear.

3. Sliding grating according to claim 1, characterized in that the depression (13) contains at least one device (19) which obstructs the material from moving in the longitudinal direction relative to the grating plate.

4. Sliding grating according to claim 3, characterized in that the device is designed as a transverse rib (19).

5. Sliding grating according to claim 1, characterized in that the cover wall (7) in the depression (13) contains longitudinal slits (8) for forming the cooling-air-outlet openings (10), which, including their borders, are covered by cover strips (9).

6. Sliding grating according to claim 5, characterized in that the cover strips (9) are arranged such that they cannot expand in the longitudinal direction with respect to the cover wall (7).

7. Sliding grating according to claim 5, characterized in that the cover strips (9) are firmly connected to that part of the grating plate which forms the sliding surface (6).

8. Sliding grate according to claim 5, characterized in that an end strip (11) is firmly connected to the cover strips (9).

9. Sliding grating according to claim 6, characterized in that the cover wall (7) is firmly connected to the base wall (16).

10. Sliding grating according to claim 6, characterized in that, in the vicinity of the front end of the cover strips (9), an abutment sliding surface (14) is provided between the top plate part (2), which comprises the cover strips, and the bottom plate part (1), which comprises the cover wall (7), the direction of which abutment sliding surface differs from the direction of the surfaces of the cover wall (7) and of the cover strips (9), said surfaces delimiting the cooling-air-outlet openings (10), with an upwardly open, obtuse angle ($\alpha$) being formed in the process.

11. Sliding grating according to claim 1, characterized in that the depression (13) of the material-receiving surface extends over the entire grating-plate width.

12. Sliding grating according to claim 1, characterized in that the longitudinal gap (20) between two adjacent grating plates is covered by an insertion strip (22).

* * * * *

UNITED STATES PATENT AND TRADEMARK OFFICE

CERTIFICATE OF CORRECTION

PATENT NO. : 5,882,189
DATED : March 16, 1999
INVENTOR(S) : Fehsenmayr et al

It is certified that error appears in the above-indentified patent and that said Letters Patent is hereby corrected as shown below:

On the title page: Item ]30]

Foreign Application Priority Data, delete "May 9, 1996" and insert --October 31, 1994--.

Signed and Sealed this

Ninth Day of November, 1999

*Attest:*

Q. TODD DICKINSON

*Attesting Officer*

*Acting Commissioner of Patents and Trademarks*